US006991432B2

(12) United States Patent
Williams

(10) Patent No.: US 6,991,432 B2
(45) Date of Patent: Jan. 31, 2006

(54) LABYRINTH SEAL FOR FAN ASSEMBLY

(75) Inventor: Edward Williams, St. Louis, MO (US)

(73) Assignee: Good Earth Tools, Inc., Crystal City, MO (US)

( * ) Notice: Subject to any disclaimer, the term of this patent is extended or adjusted under 35 U.S.C. 154(b) by 0 days.

(21) Appl. No.: 10/644,605

(22) Filed: Aug. 20, 2003

(65) Prior Publication Data

US 2004/0033134 A1 Feb. 19, 2004

Related U.S. Application Data

(63) Continuation of application No. 09/989,842, filed on Nov. 19, 2001, now Pat. No. 6,648,601.

(51) Int. Cl.
*F04D 29/08* (2006.01)

(52) U.S. Cl. ..... 416/186 R; 416/224; 416/241 B

(58) Field of Classification Search ..... 416/146 R, 416/186 R, 224, 229 R, 230, 241 R, 241 B
See application file for complete search history.

(56) References Cited

U.S. PATENT DOCUMENTS

| | | | | |
|---|---|---|---|---|
| 1,985,705 A | | 12/1934 | Whiton, jr. | |
| 4,671,740 A | | 6/1987 | Ormiston et al. | |
| 4,721,313 A | | 1/1988 | Pennink | |
| 4,884,820 A | * | 12/1989 | Jackson et al. | 416/241 B |
| 5,244,216 A | | 9/1993 | Rhode | |
| 5,423,660 A | | 6/1995 | Sortor | |
| 5,925,955 A | | 7/1999 | Norris | |

FOREIGN PATENT DOCUMENTS

JP 02011899 A * 1/1990

* cited by examiner

*Primary Examiner*—Edward K. Look
*Assistant Examiner*—Richard A. Edgar
(74) *Attorney, Agent, or Firm*—Dawn C. Wolff; Storm LLP

(57) ABSTRACT

Attaching a labyrinth seal composed of wear-resistant material to the surfaces of rotating equipment subject to wear can increase the life of the rotating equipment and reduce down-time for equipment maintenance and repairs.

17 Claims, 3 Drawing Sheets

LABYRINTH SEAL FOR FAN ASSEMBLY

This is a continuation of application Ser. No. 09/989,842, filed Nov. 19, 2001, now U.S. Pat. No. 6,648,601.

BACKGROUND OF THE INVENTION

In rotating machines, such as turbines, power expanders, power plant fans, pumps, and the like, a fluid, such as a liquid or gas is often rotated through the machine. Frequently, the liquid or gas component contains suspended solids. When these solids strike against the exposed surfaces of the machine, it can cause accelerated wear on the machine surfaces. This wear generally does not occur evenly, and greater wear is seen in areas where the solids are projected against the surface, or currents or eddies form in the gas or liquid stream, retaining a portion of the stream in contact with part surfaces for an extended time. Often, the solid material will completely wear away the machine parts, necessitating repair or replacement of the worn parts. Often, these assemblies are located deep inside machinery, and the entire system must be shut down and dismantled to gain access to worn parts. A longer time duration between machine shutdowns, which increases productivity and reduces down time, is desirable in these circumstances.

One solution to this wear problem has been to place a coating or liner on the exposed surfaces which are subject to wear to slow or reduce the wear. When the liners on the areas more subject to wear have deteriorated, they can be replaced, eliminating the need to replace the entire part. However, thin coatings which are sprayed or painted on are often insufficient to slow wear significantly enough to warrant the expense and time of coating. Another solution has been to construct the rotating equipment of a material that is more resistant to wear. However, this tends to be cost-prohibitive because such materials are generally expensive, and are only needed in areas where there is actual contact of the solids with the surface. Yet another solution has been to attach a solid layer of wear-resistant material to the areas of the machinery that experience wear, or etching. However, difficulties have occurred with finding a means to adhere the wear-resistant material to the wear areas of the rotating equipment that will provide sufficient adhesion during operation of the equipment, but that can be removed when it becomes necessary to replace the wear-resistant material. Additionally, when a solid layer has been attached, difficulties have occurred with the solid material experiencing cracking or fracture failures when the machine starts or stops because the solid material is not flexible enough to withstand the torque applied during starting and stopping.

Therefore, what is needed is a means to slow or reduce wear in the areas of rotating equipment which see the greatest wear that is of sufficient durability that the equipment can go for long periods between replacement of the wear-resisting means, while finding a material that will not experience fractures during machine starts and stops.

BRIEF SUMMARY OF THE INVENTION

Labyrinth seals are formed by layering, or lapping materials in a way to deflect or slow the flow of materials, or minimize leakage of materials through the seal. Labyrinth seals are frequently employed when it is desired to keep materials in, or out of, certain areas of equipment, such as keeping gases out of areas where sparks are generated, or keeping solids away from rotating drive shafts where the solids could accumulate, and slow or stop rotation, or damage the shafts by wear.

The present invention involves attaching a labyrinth seal to high wear areas in rotating machines to slow or reduce wear. The irregularly shaped adjacent edges where the material is lapped help to alter the normal turbulence paths across the surface of the rotating equipment, and thus reduce wear. Additionally, in areas that involve junctions of two parts, where the greatest amount of wear is generally seen, an additional layer of labyrinth seal can be attached to the joint areas to slow or reduce wear in these areas even further. Because the labyrinth seal is comprised of individual tiles, the seal has sufficient flexibility to move slightly and therefore withstand cracking or fracturing when the fan is started and stopped.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
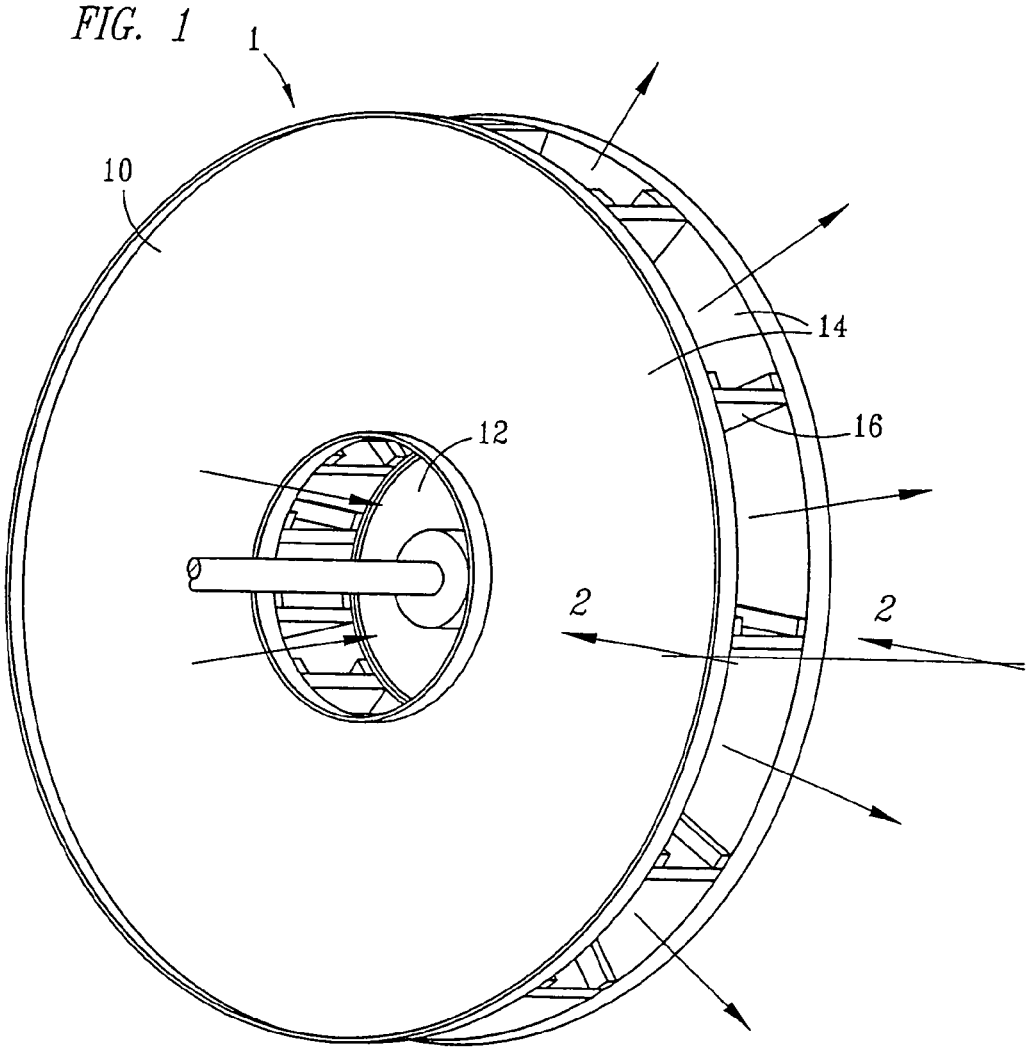
FIG. 1 is a perspective view of an installation of a coal-fired power system fan embodying features of the present invention.

In the discussion of the FIGURES the same reference numerals will be used throughout to refer to the same or similar components. In the interest of conciseness, various components known to the art, such as motors, combustion chambers, and the like, have not been shown or discussed. One arrangement of the present invention, the installation of a labyrinth seal on a fan in a coal-fired power plant, is depicted and described herein. It can be appreciated by those skilled in the art that other arrangements and uses for the present invention not described in detail herein are also included within the scope of the present invention.

FIG. 1 shows an embodiment of the present invention, the installation of a labyrinth seal on portions of the fan in a coal-fired power plant. The reference numeral 1 generally designates a fan system assembly embodying features of the present invention. The system 1 includes a fan 10, defining a non-sealed hub 12, and two sides 14 comprising the outer perimeter of the fan. The fan also has a number of fan blades 16 that extend from the hub to the outside circumference of the fan that are secured between the two sides 14 of the fan. Gas or liquid and suspended coal particles are drawn into the hub 12 of the fan 10, and are projected out the circumference of the fan.

Figure 2:
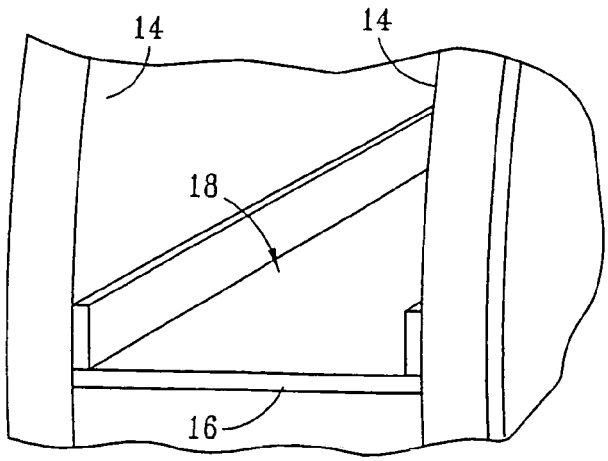
FIG. 2 is a side elevation view of the system of FIG. 1 taken along the line 2—2 of FIG. 1.

As shown in FIG. 2, channels 18 are formed by the fan blade 16 and fan sides 14. When the gas or liquid containing solid particles flows through the channels 18 of the fan 10, turbulence occurs, and increased wear areas are seen, particularly along the channel edges, where the solids tend to accumulate out of the flow stream. The extended contact of the particles against these surfaces causes the surfaces to wear away more quickly.

The areas subject to increased wear will vary based on the liquid or gas being projected through the channels 18, and the solids within that liquid or gas. By knowing where the greatest turbulence will occur in a particular machine, a labyrinth seal 100 can be designed and installed to minimize wear created by the friction. When the friction is reduced, wear in those areas is also reduced, resulting in a seal or liner that does not wear as quickly in those high stress areas. Because the seals slow part wear, decreased down time for replacement of seals or machine parts results.

Figure 3:
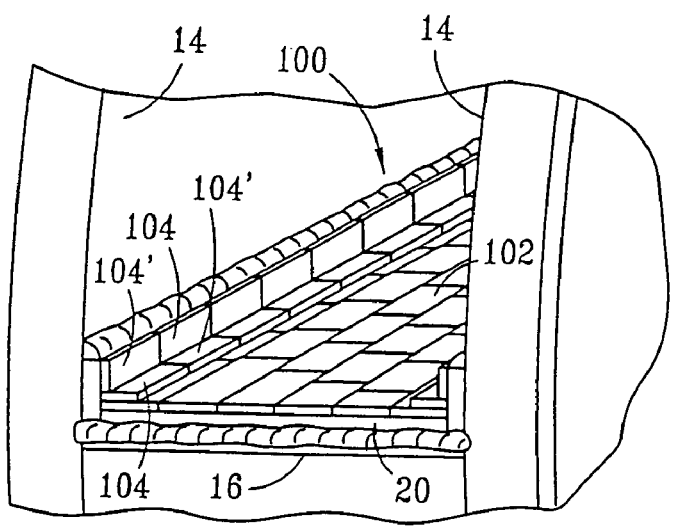
FIG. 3 shows an expanded view of one arrangement of a labyrinth seal of the present invention fully installed on a fan blade.
Figure 4:
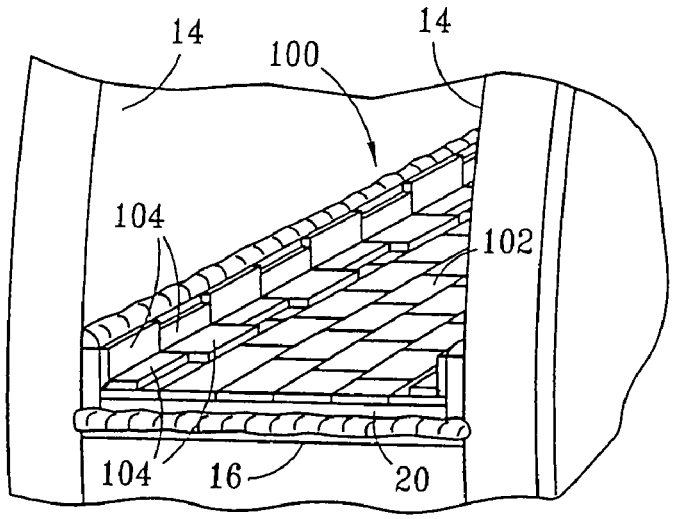
FIG. 4 shows an expanded view of an alternative arrangement of a labyrinth seal of the present invention fully installed on a fan blade.

As shown in FIGS. 3 and 4, a labyrinth seal 100 can be attached along the surfaces of the fan blades 16 and fan sides 14 which are struck most frequently by the suspended particles to reduce the wear. The labyrinth seal 100 is comprised of a series of plates 102 securely attached to the fan sides 14 and the face of the fan blade 16 or a substrate 20 that is secured to the face of the fan blade 16. The seal extends to cover the surfaces with which the gas or liquid and suspended particles come in contact and cause wear.

The plates may be attached by brazing or soldering, or by other methods such as the use of an epoxy material, depending on the material composition of the plates 102, the fan blade 16, and fan sides 14. The material compositions and attachment methods also determine if a substrate 20 should be inserted between the plates 102 and the fan blade 16. The seal is comprised of a series of plates 102, rather than a single sheet of material, because the edges of the plates 102 tend to reduce the turbulence of the gas or liquid across the surface of the seal 100 by breaking up the flow, whereas a single smooth surface would increase the flow speed, causing additional wear on the labyrinth seal 100. Additionally, individual plates can move slightly in relation to each other, therefore withstanding the torque experienced when the fan starts or stops without cracking or fracturing such as a single large surface might experience.

The labyrinth seal 100 is further comprised of a series of tiles 104 secured along the area of the channels 18 where the fan blade 16 and the fan sides 14 are joined. Because this is the area of the fan 10 subject to the most wear, the labyrinth seal 100 in this area must reduce the friction wear caused by the solids in the gas or liquid stream more than in other areas in the fan 10. The extra layer of tiles 104 in the labyrinth seal 100 creates a surface that causes turbulence that breaks up the gas or liquid stream flow, and therefore slows down the speed of the gas or liquid, and the speed of the suspended particles. Because the particles contact the surfaces at a slower speed, the wear in these areas is reduced such that it approximates to the wear in the other areas of the labyrinth seal 100. Additionally, like the plates, the individual tiles can move slightly in relation to each other, therefore withstanding the torque experienced when the fan starts or stops without cracking or fracturing such as a single large surface might experience.

The tiles 104 are preferably of the same width and thickness. In one arrangement of the present invention, as depicted in FIG. 3, tile 104 is preferably of a length that is longer than tile 104' by an amount equal to the thickness of the tiles. This enables creation of a sealed area that has even edges by alternating tiles when installed as described below. In an alternative arrangement of the present invention, as depicted in FIG. 4, the tiles 104 are all of approximately the same length. When the seal is assembled, the edges are uneven. This type of arrangement of tiles is typically used when it is necessary to reduce the flow stream turbulence further to diminish wear.

The tiles 104 are preferably laid side by side along the surface of the fan blade 16, and another row of tiles 104 is preferably positioned side by side along the edge of the fan side 14. These tiles 104 are secured to the edge of the fan blade 16 where it joins the fan sides 14 in such a manner that the components project out beyond the rest of the plates 102 along the area where the fan blade 16 and fan sides 14 are joined.

Figure 5:
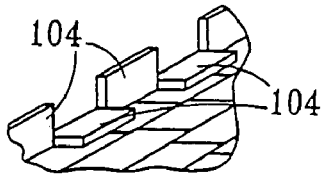
FIG. 5 is an expanded view of one arrangement of a labyrinth seal of the present invention partially mounted on a fan blade during construction of the labyrinth seal.
Figure 6:
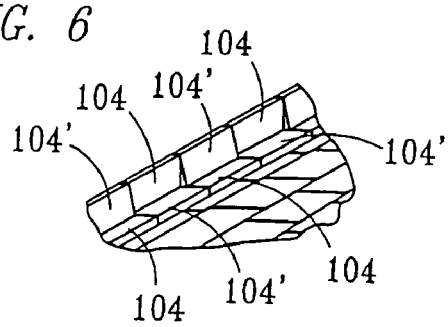
FIG. 6 is an expanded view of one arrangement of a labyrinth seal of the present invention mounted on a fan blade during construction of the labyrinth seal.

As shown in detail in FIGS. 5 and 6, in one arrangement of the present invention, tile 104 is of a greater length than tile 104'. One tile 104 is positioned on the fan blade 16 such that the end of the tile 104 abuts the fan side 14, and the corresponding shorter tile 104' positioned along the fan side 14, has the end abutting tile 104. Each adjacent set of tiles are preferably positioned in an alternating pattern such that an end of the longer tile 104, positioned on the fan side 14 abuts the fan blade 16, and the corresponding shorter tile 104', positioned along the fan blade 16 has an end abutting tile 104. This produces edges and seams that form a path along which the gas or liquid stream flows.

Figure 7:
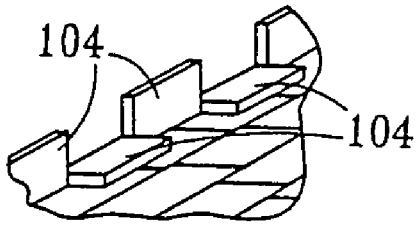
FIG. 7 is an expanded view of an alterative arrangement of a labyrinth seal of the present invention partially mounted on a fan blade during construction of the labyrinth seal.
Figure 8:
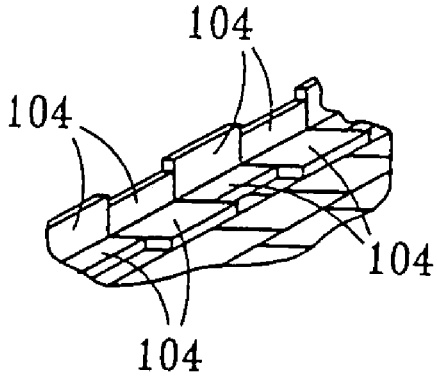
FIG. 8 is an expanded view of an alternative arrangement of a labyrinth seal of the present invention mounted on a fan blade during construction of the labyrinth seal.

As shown in detail in FIGS. 7 and 8, in an alternative arrangement of the present invention, all tiles 104 are of the same length, width, and height. One tile 104 is positioned on the fan blade 16 such that its end abuts the fan side 14, and the corresponding tile 104 positioned along the fan side 14, has the end abutting first tile 104. Each adjacent set tiles 104 are positioned such that the end of the first tile 104, positioned on the fan side 14 abuts the fan blade 16, and the corresponding tile 104 positioned along the fan blade 16 has the end abutting the first tile 104. This produces edges and seams that are not smooth, and form a tortuous path along which the air stream flows.

Typically, the labyrinth seal 100 is composed of a wear-resistant material, such as a metal carbide or ceramic. Such a material is more resistant to the wear caused by the striking of suspended particles, and thus further increases the life of the fan 10. Because such materials tend to be more expensive than steel or aluminum alloys, it is more economically feasible to make the entire fan out of a less expensive material, and only attach the more expensive wear-resistant seal material to those parts which are subject to wear.

It is understood that the present invention can take many forms and embodiments. Accordingly, several variations may be made in the foregoing without departing from the spirit or the scope of the invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A fan assembly for processing materials, the fan assembly comprising:

two circular side members circumscribing a hollow hub through the center;

a plurality of fan blades secured between the circular side members to form radial channels extending from the hub such that materials that enter into the hub flow through the radial channels, out the circumference of the fan assembly, the fan blades having secured to at least one side a layer of plates made of a material harder than the material of the fan blades, the plates being in an alternating adjacent arrangement to form irregular seams; and a layer of tiles of the same material as the plates secured along the intersection of the fan blades and circular side members, the tiles being in an alternating adjacent arrangement to form irregular seams, the plates and tiles being capable of flexible movement in relation to other plates and tiles so as to prevent breaking or cracking of the plates and tiles when the fan assembly is in motion.

2. The fan assembly of claim 1 wherein the irregular seams formed by the tiles cause turbulence in and slow the rate at which the materials are projected through the channels.

3. The fan assembly of claim 1 wherein the plates are arranged on the fan blades so as to form irregular seams that cause turbulence in and slow the rate at which the materials are projected through the channels.

4. The fan assembly of claim 1 wherein the plates and tiles are composed of a metal carbide.

5. The fan assembly of claim 1 wherein the plates and tiles are composed of a ceramic material.

6. The fan assembly of claim 1 further comprising an adhesive substance to secure the plates and tiles to the fan.

7. The fan assembly of claim 1 further comprising means for securing the plates and tiles to the fan by brazing.

8. The fan assembly of claim 1 further comprising securing a substrate between the fan blade and the plates.

9. The fan assembly of claim 1 wherein all exposed edges of the tiles and plates adjoining the fan blade and side members are sealed.

10. A method of prolonging the life of a rotating fan assembly having circular side members with a plurality of fan blades secured between the side members to form radial channels, the method comprising the steps of:

securing a layer of plates to at least a face of a blade of the fan assembly, the plates of a harder material than the material of the blade, the plates arranged to form a pattern of irregular seams, the plates being capable of flexible movement in relation to each other; and securing a layer of tiles of harder material along at least a portion of at least one joint of the fan blade and the side members to form an "L" shape along the length of the joint, the tiles having front and back faces, top and bottom ends and left and right sides, the tiles being arranged such that:

a first tile of a first pair of tiles is positioned substantially vertically along the circular side member, with the back face of the tile adjacent to the circular side member, and the bottom edge abutting the plates on the blade, a second tile of the first pair positioned substantially horizontally along the plates on the blade, with the back face of the tile adjacent the plates, and the top edge of the tile abutting a portion of the front face of the first tile;

a second pair of tiles arranged such that a first tile of the second pair is positioned substantially horizontally along the plates on the blade, with the back face of the tile adjacent to the plates, the top edge of the first tile of the second pair abutting the circular side member, a second tile of the second pair positioned substantially vertically along the circular side member, with the back face of the second tile of the second pair adjacent the circular side member, the bottom edge of the second tile of the second pair abutting a portion of the front face of the first tile of the second pair; and alternating first and second pairs of tiles along the length of the joint to form an irregular seam, the tiles being positioned so as to be capable of flexible movement in relation to each other and the plates.

11. The method of claim 10 wherein all tiles are of approximately a same size so that the outside ends of the "L" shaped joint form an irregular edge.

12. The method of claim 10 wherein the length of the tiles of the second set are shorter than the tiles of the first set by an amount approximately equal to a thickness of the tiles so that the outer ends of the "L" shaped joint form a substantially even edge.

13. The method of claim 10 further comprising sealing the edges of the tiles along the outside edges of the "L".

14. A method of prolonging the life of a rotating fan assembly consisting of circular side members having a plurality of fan blades secured between the circular side members to form radial channels, the method comprising the steps of:

securing a layer of plates of a hardened material to at least a face of a blade of the fan assembly, the plates arranged to form a pattern of irregular seams, the plates being capable of flexible movement in relation to each other;

securing a layer of tiles of harder material of different sizes along at least a portion of at least one "L" shaped joint formed by the intersection of the fan blade and the circular side members, the tiles having front and rear faces, left and right sides and top and bottom edges, the tiles being positioned such that a row of tiles is positioned with their rear face adjacent the circular side member, and a second row of tiles is positioned with their rear face adjacent the plates secured to the blade; and arranging adjacent tiles in a staggered manner in respect to each other so as to form an irregular seam at the inside angle of the "L" shaped joint to slow a flow of materials projected through the channels, the tiles being capable of flexible movement in relation to other tiles and the plates so as to prevent breaking or cracking of the plates and tiles.

15. The method of claim 14 wherein the tiles are arranged so that the edges of the tiles projecting out from the "L" form a substantially straight line.

16. The method of claim 14 wherein the tiles are arranged so that the edges of the tiles at the outside of the "L" shaped joint form a non-even line.

17. The method of claim 14 further comprising sealing the edges of the tiles at the outside edges of the "L" shaped joint.

* * * * *